US008439361B2

(12) United States Patent
Weinreich

(10) Patent No.: US 8,439,361 B2
(45) Date of Patent: May 14, 2013

(54) SLAT PUZZLE

(76) Inventor: Steve Weinreich, Monmouth Junction, NJ (US)

( * ) Notice: Subject to any disclaimer, the term of this patent is extended or adjusted under 35 U.S.C. 154(b) by 274 days.

(21) Appl. No.: 12/767,116

(22) Filed: Apr. 26, 2010

(65) Prior Publication Data

US 2010/0270739 A1 Oct. 28, 2010

Related U.S. Application Data

(60) Provisional application No. 61/214,682, filed on Apr. 27, 2009.

(51) Int. Cl.
*A63F 9/08* (2006.01)

(52) U.S. Cl.
USPC ..... 273/157 R; 273/156

(58) Field of Classification Search ..... 273/157 R, 273/153 R, 156
See application file for complete search history.

(56) References Cited

U.S. PATENT DOCUMENTS

| | | | | | |
|---|---|---|---|---|---|
| 904,387 | A | * | 11/1908 | Welsh | 273/157 R |
| 1,257,432 | A | * | 2/1918 | Wetzel | 273/157 R |
| 1,636,371 | A | | 7/1927 | Kenney | |
| 1,709,660 | A | * | 4/1929 | De Bracht | 273/157 R |
| 2,491,296 | A | | 12/1949 | Beder | |
| 2,581,492 | A | * | 1/1952 | Lowe et al. | 273/157 R |
| 3,643,956 | A | * | 2/1972 | Bovasso | 273/275 |
| 3,817,492 | A | * | 6/1974 | Raymer | 283/63.1 |
| 3,854,726 | A | * | 12/1974 | Balder | 273/157 R |
| 4,436,309 | A | * | 3/1984 | Barlow et al. | 273/267 |
| 4,471,960 | A | * | 9/1984 | Murphy | 273/157 R |
| D351,196 | S | * | 10/1994 | Baray | D21/478 |
| 5,407,201 | A | * | 4/1995 | Whitehurst | 273/157 R |
| 5,692,749 | A | * | 12/1997 | Vogeler | 273/157 R |
| 6,203,013 | B1 | * | 3/2001 | Nitsche et al. | 273/153 R |
| 7,159,866 | B2 | * | 1/2007 | Selph | 273/157 R |
| 7,789,392 | B2 | * | 9/2010 | Kishon | 273/157 R |
| 2004/0061287 | A1 | * | 4/2004 | Vaillancourt | 273/157 R |
| 2010/0019450 | A1 | * | 1/2010 | Auerbach | 273/157 R |
| 2010/0327526 | A1 | * | 12/2010 | Auerbach | 273/157 R |

* cited by examiner

*Primary Examiner* — Steven Wong
(74) *Attorney, Agent, or Firm* — Porzio, Bromberg & Newman, P.C.

(57) ABSTRACT

An improved puzzle of the type in which a target image is applied to the edge of a stack of slats. The slats are shuffled and then reassembled by the user. In the improvement, the strip of target image that is associated with the edge of each slat is extended beyond the edge, along the surface of the slat, allowing the user to more readily perceive the puzzle pattern, particularly on relatively thin slats. The improvement also allows economic manufacture from inexpensive materials by ordinary printing techniques. Slats can be printed flat, then formed by folding.

31 Claims, 5 Drawing Sheets

SLAT PUZZLE

CROSS REFERENCE TO RELATED APPLICATION

This application claims the benefit of U.S. Provisional Patent Application No. 61/214,682, filed Apr. 27, 2009, the entirety of which is hereby incorporated by reference into this application.

BACKGROUND OF THE INVENTION

Picture puzzle is a generic term for an article of manufacture that is used by people, primarily for amusement and recreation. In using a picture puzzle, a person typically assembles a coherent target image from disordered elements of the target image. Jigsaw puzzles are the most common type of picture puzzle and have been a staple amusement/recreation item for many years. Typically printed onto a finished side of a sheet of stiff cardboard, which is then die-cut, most jigsaw puzzles are of the interlocking type, where assembled pieces cannot be separated from one another without lifting one out of the plane of the puzzle. Variations have included puzzles of identically shaped interlocking pieces, puzzles printed on both sides, oddly shaped puzzles, puzzles of identically shaped rectangular pieces, and puzzles where the target image is a uniform color with no markings.

Picture puzzles have also been printed on sets of blocks of square cross section, including cubes, often with each side of each block being a section of one of four or six pictures. U.S. Pat. No. 1,636,371 to Kenney, U.S. Pat. No. 2,491,296 to Beder and U.S. Pat. No. 2,581,492 Lowe et al. are of this type. Puzzles on arrays of long, slender pieces, both square, as described in U.S. Pat. No. 2,581,492 to Lowe et al., and round, as described in U.S. Pat. No. 1,257,432 to Wetzel, are known.

Also known are picture puzzles exhibiting surface relief Interlocking picture puzzles that include joining sections of the puzzle at angles to form three-dimensional shapes are also known.

In the late 1990's, OddzOn, a subsidiary of Hasbro, Inc., sold a product called Slivers ("a slice of puzzle fun!"). The Slivers product consisted of about 50 plastic pieces, each approximately a tenth of an inch thick, one inch wide, and four inches long. The slats were stacked face to face and the stack placed on its side in a closely fitted plastic box. Vertical slices of a target image were printed, or laminated, onto the exposed edges of the slats. When the slats were properly oriented and ordered in the stack, the target image would be assembled.

Additionally, the Slivers product had a different picture on each side of the stack, which enhanced the challenge of solving the puzzle by forcing the solver to discern which long edge of each slat belonged to each of the two pictures. And the two pictures were out of sequence with each other, so, when one was assembled, the other was disassembled. Each slat was formed with tabs projecting from opposite corners, which, in cooperation with the box, enforced the end to end orientation of the visible edge of a slat, while not enforcing which long edge was placed upward. This type of puzzle is generically referred to in this disclosure as a slat puzzle.

Particular advantages of a slat puzzle over a jigsaw puzzle, which provides a similar challenge to a solver, are: a more compact structure, particularly during assembly; the area for assembly being identical to the area of the finished puzzle; that the puzzle can easily be moved about or stored while partially assembled; and there is no need for a level surface for assembly.

SUMMARY OF THE INVENTION

The present invention is an improved form of a slat puzzle, which solves substantial problems that have seriously constrained the usefulness and commercial feasibility of conventional slat puzzles. The present invention depends primarily on distorting slices of a target image, thereby allowing economic manufacture from inexpensive materials by conventional printing techniques with larger tolerances. The technique and embodiments it enables, enhance play appeal (enjoyment) and play value (entertainment per expenditure).

Among other advantages, the present invention provides for substantially thinner, therefore more numerous slats, for a more challenging and complex solving experience than conventional slat puzzle. The target image for the improved slat puzzle is divided into slices that are each applied to an edge of a slat. Unlike conventional slat puzzles, each slice is extended generally perpendicular to its long axis. Thus, the slice retains its length, while becoming substantially broader. The broadened slice is applied to the slat edge, but, because it is broader than the edge, also wraps over onto the face of the slat.

With the solving information, such as, for example, pattern and colors, no longer limited to the edge of the slat, the puzzle solver can, by slightly separating, tilting or lifting the slat, clearly see information that would have been too finely delineated on a thin edge. Therefore the slats can be thinner and their number greater than a conventional slat puzzle. And, because the information is visible beyond the slat edge, the edge need not be square and flat as in a conventional slat puzzle. The visual continuity of the assembled picture is enhanced, even where the slats are not perfectly aligned. Furthermore, the patterns on the faces of the slats have the advantage of providing a more attractive product than the blank faces of the conventional slat puzzle slats.

An assembly box can be provided. It is preferred that the assembly box be shallower than the slats are broad and that the box is, in one dimension, the length of the slats, and in the other dimension greater than the height of the slat stack, to provide space for fingers manipulating the slats. A pressure plate, such as resilient plastic foam, can be added to fill the space at the end of the slat stack, thereby stabilizing the stack, while allowing manipulation of each slat.

Target image slices of conventional slat puzzles are applied, by lamination, or drawing, or printing, onto a face or faces of the stack of slats. Each slat carries its slice of the target image only on a substantially flat edge of the slat. Printing onto a face of a stack of flat material is known as for advertising or decoration on pads of notepaper. Where the material is thin, such as notepaper, it is difficult to discern the printing on the edge of a single sheet. Such pads make poor slat puzzles, not because they aren't challenging, but because much of the challenge is in the unpleasant task of straining to make out the patterns.

Unlike conventional slat puzzles, the present invention provides slats that are printed flat, typically on paper or cardboard, then folded to form the printed edge or edges and faces. With the image slices made broader, patterns are more visible on thin edged slats. Also, in some cases, printing tolerances can be quite large, making production easier and supporting high production speeds.

The invention will be more fully described by reference to the following drawings.

BRIEF DESCRIPTION OF THE DRAWINGS

FIG. 2 illustrates several embodiments of slat structures, with and without cores:

- FIG. 3A is a schematic diagram of an image slice extended by copying.
- FIG. 3B is a schematic diagram of an image slice extended by stretching.
- FIG. 3C is a schematic diagram of an image slice extended by repetition.

FIG. 5 diagrams printed web substrates (prior to cutting and folding).

FIG. 7 is a schematic diagram of slats with target image slices applied only near the edges of the faces of the slats.

DETAILED DESCRIPTION

Figure 1:
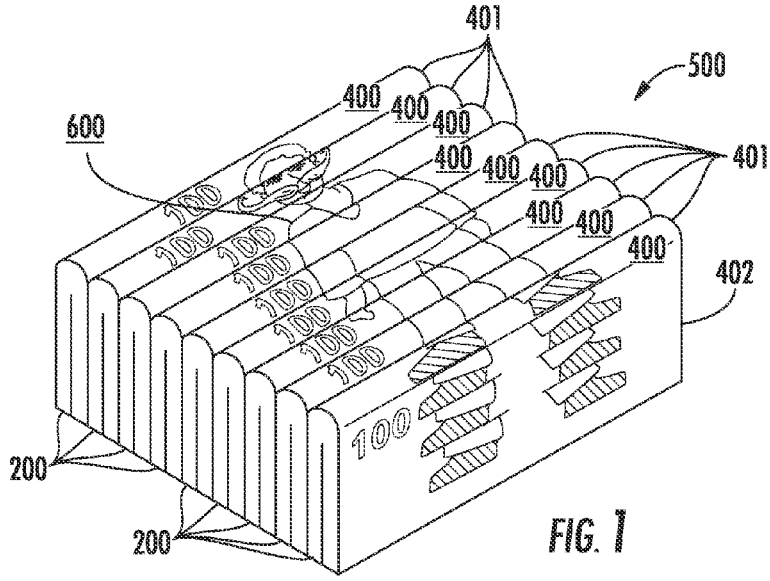
FIG. 1 is a schematic diagram of an assembled folded-slat puzzle with extended image slices.

Reference will now be made in greater detail to a preferred embodiment of the invention, examples of which are illustrated in the accompanying drawings. Wherever possible, the same reference numerals will be used throughout the drawings and the description to refer to the same or like parts.

FIG. 1 shows a completed slat puzzle 500 according to the teachings of the present invention. Puzzle 500 is comprised of a stack of a plurality of slats 400. Slats 400 are shown in sequence to complete target image 600 properly assembled. Extended target image slices 100 are formed by extending target image slices 650 perpendicular to their long axes.

Extended target image slices 100 appear on the edges 401 and extend to faces 402 of slats 400. Preferably, extended target image slices 100 appear on the slat edge with the original target image slice essentially parallel to the long axis of the slat. Preferably, slats 400 are fabricated by printing extended target image slices 100 onto substrates 200, scoring or crimping or creasing or scratching or otherwise forming lines into the substrates (to insure clean, precise folds), and folding and gluing. For example, substrate 200 can be cardboard.

FIG. 2 illustrates several embodiments of slats 400. In general, a slat is a dimensionally stable, three-dimensional, rectilinear, object.

Slat 400, as understood herein, has two relatively large, relatively flat, generally parallel faces 402, each having a length and breadth, and, separating those faces, a relatively narrow edge 401, having a thickness. Where the edge changes character or direction, such as, a right angle, sections of the edge can be referred to as separate edges, as in common speech. In addition, the common use of the term "slat" implies a substantially greater length than breadth. Those proportions are generally preferred for the present invention, but they should not be taken as limiting. A preferred slat has a rectilinear shape. It will be appreciated that other shapes of slats 400 can be used in accordance with the teachings of the present invention.

Dimensions for embodiments of the invention can vary widely, but it is generally preferred that slat thickness be from about five thousandths of an inch for example (roughly half the thickness of a conventional playing card) to about one-quarter of an inch; breadth from about three-eighths of an inch to about an inch and three-quarters; and length from about two and one-half inches to about eighteen inches. The dimensions for slats in a particular embodiment generally fall in the same end (or middle) of the range for each of the dimensions. Slats 400 in puzzle 500 are preferably, but not necessarily, the same size (including thickness).

Slats 400 comprise cores 300 and/or folded substrates 200. Substrate 200, as understood herein, is of the size necessary to form one slat 400. However, it should also be understood that, at any stage of production, several or many substrates 200 may be part of the same sheet or web of material. The sheet or web may be sheared, or otherwise divided, to separate the substrates 200, or perforated, in any pattern, preferably one leaving little attachment, for later, manual separation.

Material choices for cores 300 and substrates 200 will be readily apparent to one skilled in the art. The preferred material for cores 300 and substrates 200, without cores, is what is commonly called cardboard including, for example, chipboard, card stock, and corrugated, all of which are relatively inexpensive and ubiquitous. For slats 400 comprising folded substrates, the cardboard is preferably coated. For example the cardboard can be coated with clay or faced with higher quality paper laminated to the surface to be printed. For use in combination with cores 300, thinner substrates 200, preferably paper, are preferred.

Figure 2A:
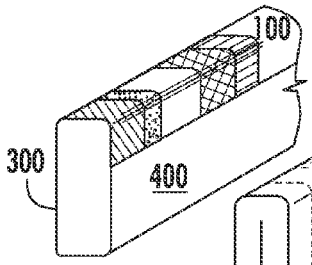
- FIG. 2A is a schematic diagram of a slat core with extended image slice.

Core 300 can be almost coincident in size and mechanical characteristics with slat 400 that's built with it. Without the images, the slats of previously known slat puzzles are cores 300 under the present parlance. FIG. 2A shows such a slat core 300, onto which an extended target image slice 100 is applied. Extended target image slice 100 can be applied by any conventional or unconventional technique, such as, for example, pad printing, hand painting, or silk screen.

Figure 2B:
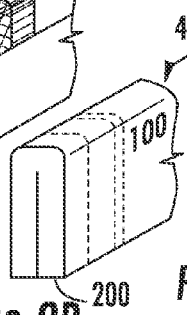
- FIG. 2B is a schematic diagram of a full single fold slat.

FIG. 2B shows slat 400 without a core 300. Substrate 200, the length of a desired slat 400 and twice its breadth, is printed with extended target image slice 100, then scored along its long centerline to insure a clean fold, preferably by a die associated with the printing equipment; then folded; and, preferably, glued.

Alternatively, the printing can be onto a pre-scored substrate 200. It should be noted that gluing is not always necessary, and unglued slats 400 of this and other forms are preferred in some embodiments, as a slight tendency to unfold can provide a gentle spring action to space slats 400 evenly in a box, while allowing the slat stack to be compressed for slat manipulation. Slats 400 can be proportioned so that the spring action doesn't cause the slat stack to buckle. Also, unglued slats 400 can present some manipulation difficulties, such as tending to catch on one another as they are inserted into the stack.

Figure 2C:
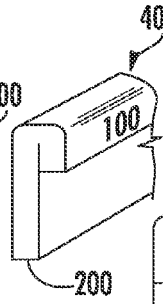
- FIG. 2C is a schematic diagram of a partial single fold slat.

Slat 400 of FIG. 2C is folded only near one edge of substrate 200, while the opposite edge remains unfolded. This form is unlike most preferred slats 400, in that the thinner, unfolded edge is not fully supported and stabilized by adjacent slats in the stack, but it can be especially useful, for example, in an arrangement where slats 400 are inserted into individual slots in an assembly rack. Separators in the rack would then not force the printed edges apart.

Figure 2D:
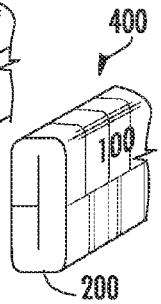
- FIG. 2D is a schematic diagram of a full double fold slat.

FIG. 2D shows substrate 200 with two folds, to form slat 400 that is uniform in thickness and can carry an extended image slice on each of two edges.

Figure 2E:
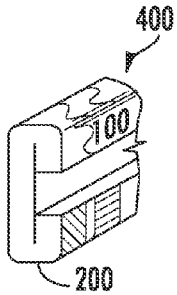
- FIG. 2E is a schematic diagram of a partial double fold slat.

Slat 400 of FIG. 2E is similar to that of 2D, having two folds in which there is a break in material between the folds to provide a slight savings in material.

Figure 2F:
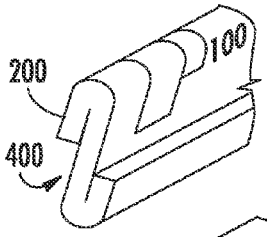
- FIG. 2F is a schematic diagram of a reverse double fold slat.
Figure 2G:
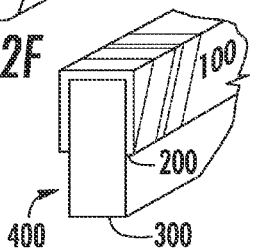
- FIG. 2G is a schematic diagram of a slat core with label.
Figure 2H:
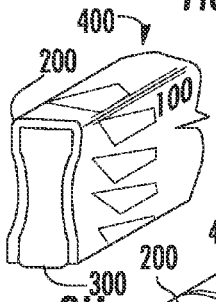
- FIG. 2H is a schematic diagram of a slat core with larger label.
Figure 2I:
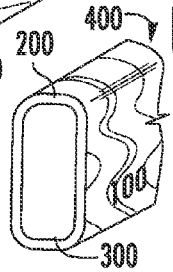
- FIG. 2I is a schematic diagram of a fully wrapped slat core.
Figure 2J:
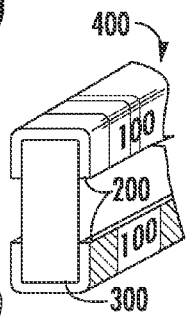
- FIG. 2J is a schematic diagram of a slat core with two labels.

FIG. 2F shows reverse double fold slat 400. A two sided puzzle 500 comprising such slats, requires substrates 200 to be printed on both sides.

In FIGS. 2G, 2H, 2I, and 2J, thin substrates 200, carrying extended target image slices 100, are bonded to cores 300 in various configurations. Bonding can be by any conventional or unconventional technique, such as glue, staples, or tape, including using adhesive labels as pre-bonded substrate material.

Figure 2K:
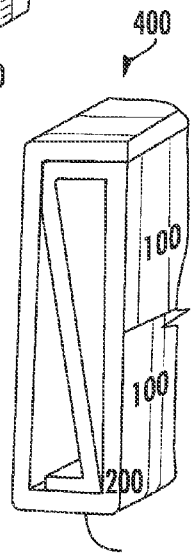
- FIG. 2K is a schematic diagram of a multi-fold slat with web.

Shown in FIG. 2K, large slats 400 can be formed as narrow hollow boxes, with no cores. Dimensional stability is insured by end closures and/or an internal diagonal web that can be a continuation of the box material. In this case, the slat edge is formed by two right-angle folds instead of a single fold. An edge defined by two folds can also be useful in any of the previously described slat configurations, where it is desired to have a particularly flat edge and/or with relatively thick substrate materials.

Figure 3:
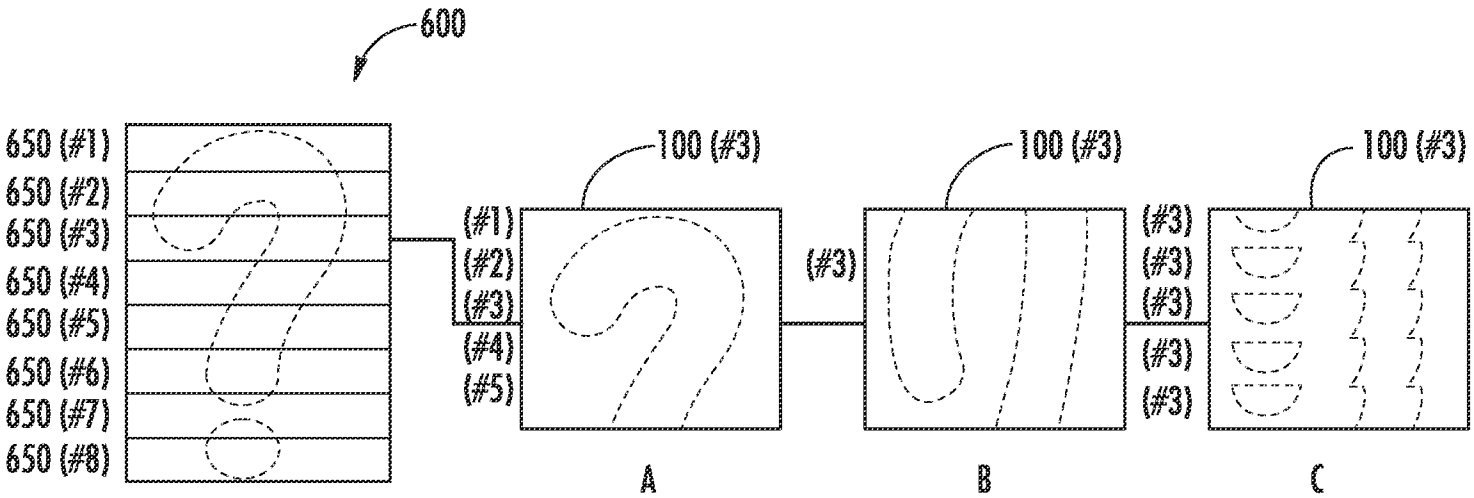
FIG. 3 shows three kinds of extended image slices.

FIG. 3 shows three kinds of extended target image slices 100. In each case, artwork for target image 600, acquired in any conventional or unconventional way as, for example, by photography, drawing, clip-art, or gyotaku (Japanese fish printing), is adjusted or cropped to an appropriate size for a puzzle 500. The artwork is usually the same size as the intended slat stack, but the following techniques may require original artwork slightly larger than that. A target image is understood to be essentially the same size as the slat stack with which it is associated. Target image 600 is then divided into a plurality of target image slices 650 to match the number of slats 400 intended for puzzle 500. As a result, target image slices 650 are approximately as wide as intended slats 400 are thick.

Each target image slice 650 is then extended perpendicular to its long axis to any desired degree to present solving information and/or for other design reasons to form extended target image slice 100. Extended target image slice 100 is extended preferably to at least three times the thickness of slat 400.

In FIG. 3A, target image slice 650 is extended by copying and concatenating adjacent target image slices 650 of target image 600. Thus (with the slices numbered in their original, assembled sequence, from top to bottom) slice 3 could be extended by copying slices 1 and 2 and concatenating them to its top edge and copying slices 4 and 5 and concatenating them to its bottom edge.

The resulting image is preferably continuous, not divided into strips. With extension by copying, the original art work is preferably longer, in a direction perpendicular to the slices, by the width of one extended target image slice, at least. That is to provide material for extension of the extreme slices 650 of target image 600.

The described image manipulation can be done, almost manually, by making several physical copies of the artwork and slicing them apart on a conventional paper cutter. The several copies are needed because successive extended slices overlap each other. Common methods of computer image manipulation, including those in commercial software packages like Adobe PhotoShop, particularly slice and divide tools, are suitable, and usually preferred.

In FIG. 3B, target image slice 650 is extended by stretching either each slice 650 or the entire target image 600 before slicing. Conventional computer software, including Adobe PhotoShop, provides handles and tools to stretch images and tools to slice them. Alternatively, a stretching operation can be accomplished by physically dragging an original image along the glass of a copy machine or scanner as it is copied, but that's not necessarily a practical approach. A stretched version of target image 600 can also be relatively easily created as original artwork.

In FIG. 3C, the slice is extended by repetition. A starting pattern, can be entire target image slice 650 or a representation of target image slice 650. Such a representation can be, for example, a slender sample parallel to the long axis of target image slice 650, or an essentially linear image, maybe no more than a pixel wide, showing the average color and average brightness at closely spaced cross sections of target image slice 650. The starting pattern is then repeated several or many times, each repetition being displaced by its own width, generally perpendicular to the long axis of the slice, to form extended target image slice 100.

Repetition of the image slice itself can, in principle, be accomplished with a paper cutter and glue if one has enough copies of the original art work and a great deal of time and patience. Alternatively, a computer, with conventional commercial software, such as Adobe Photoshop, can be used for repetition of target image slice 650 less tediously and more precisely. A slender sample of the slice is likewise relatively easily selected and repeated, using the same software. To repeat an essentially linear representation is similarly straightforward.

In an embodiment of extension by repetition, preferred particularly for relatively thick slats 400, slender samples are selected at the extreme edges of target image slice 650. Target image slice 650 is left whole, as a portion of extended target image slice 100 that will eventually be registered on edge 401 of slat 400, as in a conventional slat puzzle. The balance of extended target image slice 100 is generated by repetition of the extreme edge samples. As a result, edge 401 of slat 400 will bear a detailed portion of target image 600; faces 402 of the slats will bear linear indications of the edge information.

In a similar preferred embodiment of extension by repetition, an essentially linear representation of target image slice 650 is repeated at each edge of target image slice 650 to form extended image slice 100.

With extension by repetition, regardless of which starting pattern is used, registration with the slat edge may not be critical. Essentially, any portion of such extended target image slice 100 that falls on the edge of the slat will present the same sequence of color and brightness along the slat edge as any other portion. Only where slats 400 are relatively thick and entire target image slices 650 are retained in extended target image slices 100 will imprecise registration of extended image slices 100 on edges 401 of slats 400 be noticeable.

An essentially linear representation of the cross sections of the image slice has to be generated, before it can be repeated. Conventional commercial image processing software can be used. One method is to shrink an image slice perpendicular to its long axis, and to use the shrunken slice as the starting pattern for repetition.

With repetition of an essentially linear representation of target image slice 650, image detail will be removed, which can result in a more challenging puzzle 500, especially where slats 400 are relatively thick. However, completed target image 600 will show as a coarser grained version of the original artwork. Where slats 400 are relatively thin, the difference will not be so noticeable. In either case, extended image slice 100 need not be precisely registered on slat edge 401.

Each kind of extended image slice has characteristics that can provide advantages or disadvantages in particular embodiments. Those image slices extended by copying must be precisely registered on the slat edges; they provide a lot of information for the solver; they are very simple to generate. By comparison, those image slices extended by stretching are not so sensitive to registration on the slat edges; provide somewhat less information to the solver; are a little more difficult to generate; cause the assembled target image to be discontinuous from slat to slat. Those image slices extended by repetition may not need to be precisely registered on the slat edges; in many cases provide minimal information for the solver; are sometimes more difficult to generate; allow more varied design choices. Also, the visual texture of assembled puzzles will depend on the kind of extension.

Figure 4:
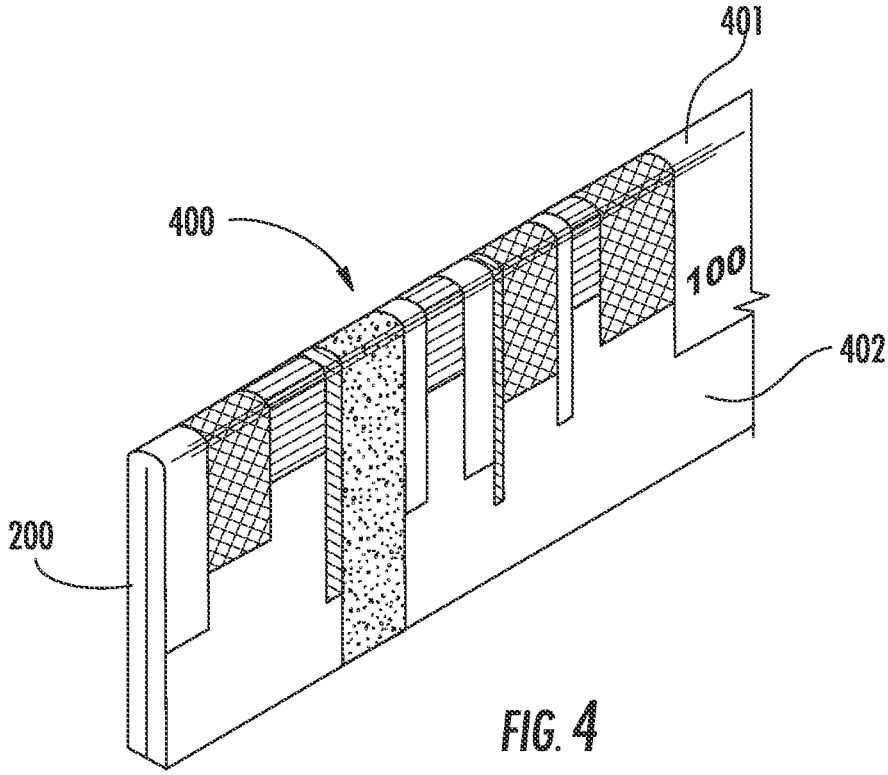
FIG. 4 is a schematic diagram of a representative variation of an extended image slice.

Varied design choices include non-uniform extension (different image components to different extents) of an image strip, such as differential extension by color or by area, or by any other characteristic, or even randomly. For a preferred embodiment of this effect, a roughly linear starting pattern is repeated, essentially as described above. But, as the repetitions are laid down, successive repetitions are modified by fading out different colors at different rates. Or some color can be abruptly terminated after so many repetitions, an additional color after so many more repetitions, and so forth. This effect is illustrated in FIG. 4. In FIG. 4, repetition of an essentially linear representation of a target image slice 650 has resulted in a pattern of color bands. Also, successive repetitions can be slightly displaced parallel to the long axis of the slice, several stepping in one direction and then several stepping back, to present the slice extension in a wavy pattern.

For an effect similar to repetition of a very narrow target image slice 650, or of a linear representation of a target image slice 650, extension can be accomplished by physically smearing the ink of each image slice after (or during) printing.

Neither the discussion of kinds of target image slice extension nor the design choice descriptions should be taken as exhaustive.

Extended target image slices 100 have to be organized for printing, which should be understood to mean any reasonable method of reproduction. Whether each substrate 200 is to be printed individually, or as part of a sheet or web, the order and orientation of the successively printed extended target image slices 100 have to be determined. If the intent is to produce an assembled puzzle 500, substrates 200 are best printed with extended image slices 100 in sequence. However, it is preferred to present puzzle 500 unassembled, so its extended target image slices 100 should be printed in irregular, for example, not readily apparent order. Some puzzles 500 will also benefit by presenting the extended target image slices 100 oppositely oriented in irregular order. That is especially important in such embodiments as those with slats 400 of FIG. 2D, where it is desirable to disguise the orientation of the slats by disconnecting the correct orientation of the information from the orientation of the butt seam on one face of the slat 400. Also, for slats 400 shown in FIG. 2D, or others, used in a two-sided puzzle 500, extended target image slices 100 of a first target image 600 and extended target image slices 100 of a second target image 600 must be arranged so that each slat 400 will comprise, on opposite edges, extended target image slices 100 from each of the target images 600.

Figure 5A:
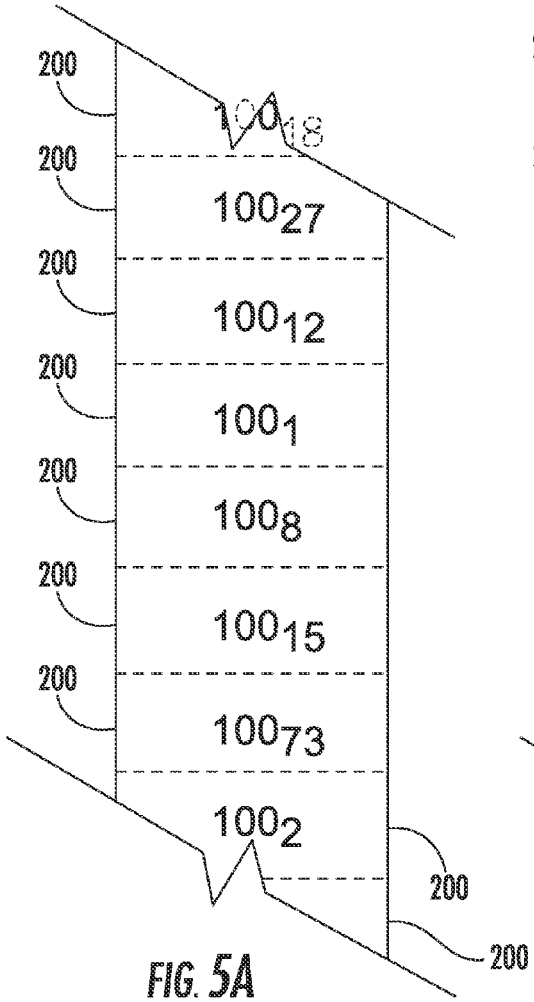
- FIG. 5A is a schematic diagram of a web with lateral perforations, and with successive extended image slices printed in irregular sequence.
Figure 5B:
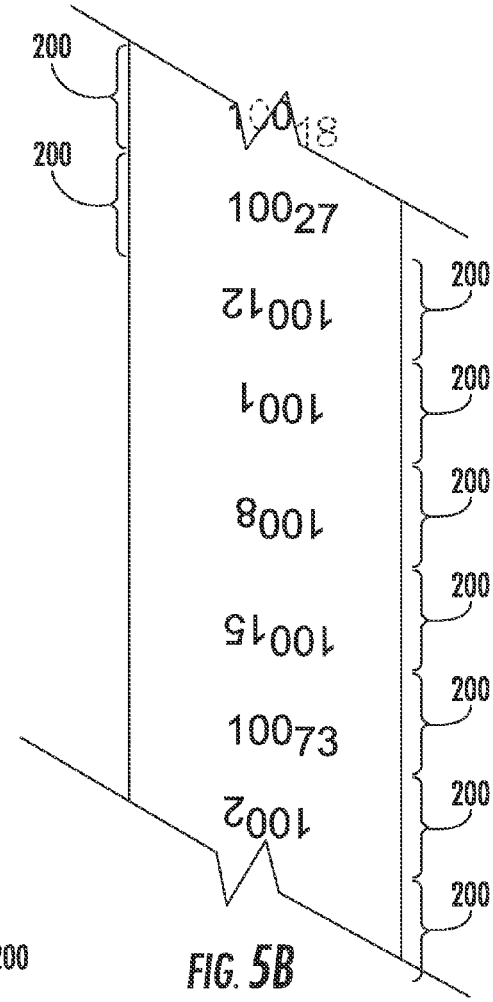
- FIG. 5B is a schematic diagram of a web with successively printed extended image slices oppositely oriented in an irregular order.

FIG. 5 diagrams printed web substrates 200 prior to cutting and folding. In FIG. 5A, successive extended target image slices 100 are printed out of their original sequence. In FIG. 5B, successive extended target image slices 100 are printed in an irregular sequence of orientation. FIG. 5A also shows the web as laterally perforated between successive substrates 200.

Contrary to the diagram representation, one should not expect to find the slat sequence numbers on slats 400 of a real puzzle.

Target image 600 can be any graphic image, simple or complex, realistic or not, in colors or not. However, to be useful, target image 600, or at least a substantial portion of it, must be distinguishable as properly sequenced or not. Target images 600 should recognize the unique physical structure of a slat puzzle. For example, a picture that includes a recognizable major element that crosses many slats 400 at an angle, may severely reduce a puzzle's difficulty. It should be noted that an adjustment of the angle of the slices can be helpful to make such artwork more useful; the artwork need not be square to the slat orientation.

While it is generally preferred that each slat 400 be the same length, the lengths of the slats can be divided, into equal segments or not, and identically to other slats or not and assembled into the same assembly box or adjacent boxes, or into one box divided into columns or other sections.

Figure 6:
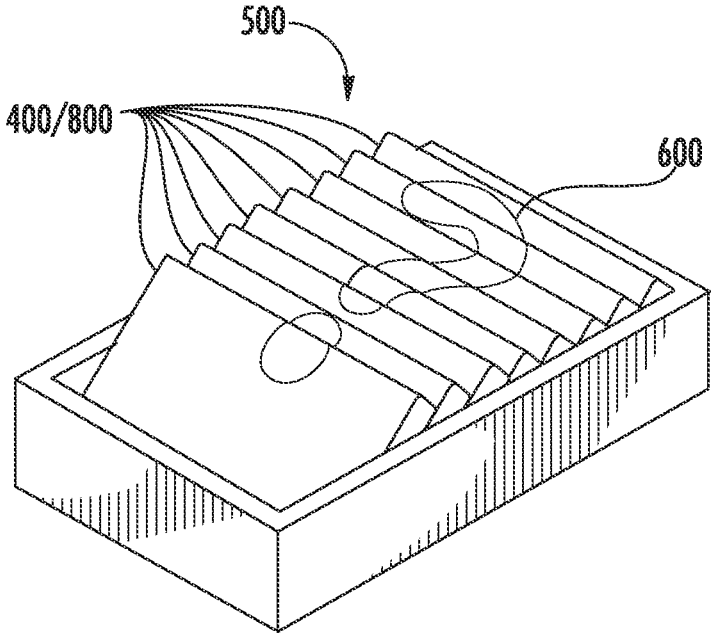
FIG. 6 is a schematic diagram of a slat puzzle with tilted slats.
Figure 7A:
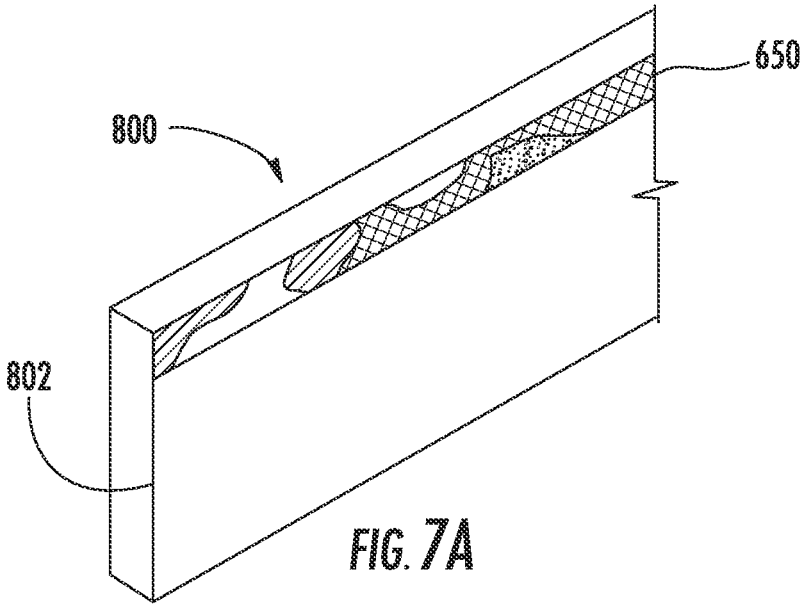
- FIG. 7A is a schematic diagram of such a slat with an image slice.
Figure 7B:
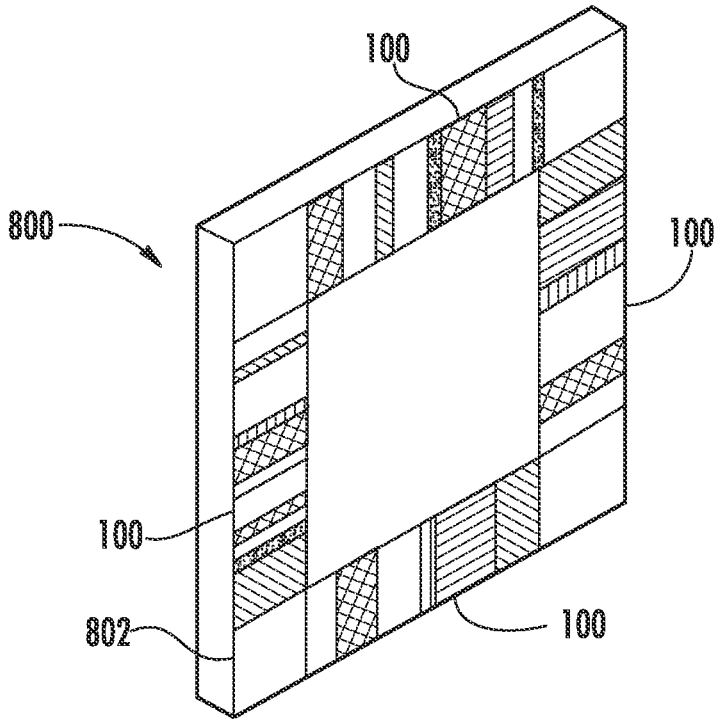
- FIG. 7B is a schematic diagram of such a slat; square, with extended image slices.

As shown in FIG. 6, an assembly box can be arranged, with or without a sloped side or internal wedge, to allow the slats to tilt, thereby offsetting each slat from the next to expose the faces of the slats, adjacent to the edges of the slats. With the slats tilted sufficiently away from an observer, the slat edges are hidden from view; there is no apparent distinction between a slat with printing on its edge and one without. The slats shown in FIG. 6 are numbered 400/800 as either type can be used in such an embodiment.

Where the slats are so tilted in relation to the box, they can be printed only on their faces, adjacent to edges. That does not require folding of a substrate 200. FIG. 7A shows a slat 800 comprising target image slice 650 on slat face 802. FIG. 7B shows a slat 800 with four edges of equal length and extended target image slices 100 printed on portions of face 802 adjacent to each edge. Extended target image slices 100 are shown to terminate short of the corners of slat 800 so they do not overlap at the corners. This is a design choice; extended target image slices 100 might instead be allowed to overlap at the corners, or be mitered at the corners.

A similar square slat 400 can comprise a substrate 200 with extended image slices 100, wherein each of the four edges is folded to present the expanded image slices 100 on edges 401 and faces 402 of slat 400. In such an embodiment it is preferred to miter the corners of the folds, even where expanded image slices 400 do not reach the corners. Alternatively, the substrate can be cut to reduce the length of the sections to be folded over, so they do not interfere.

Likewise, expanded image slices 100 can be printed onto substrates 200 that are then folded over the edges of cores 300 to form square slats 400.

And, of course, other polygonal shapes can be used in the same manner.

Additionally, if the material of core 300 is sufficiently porous, inks or dyes printed onto its face can be absorbed into slat core 300 and will be visible, without folding, at slat edge 401 as well as slat face 402 of slat 400.

An assembly box can carry a key, such as a rod attached to the box bottom, perpendicular to the slats, and the slats notched to fit, thereby forcing the slats to be orientated correctly. Keys can also be printed onto the slats. A colored band along one end of the slats will show correct orientation. A puzzle can also be keyed on its bottom to confirm and/or hint at correct assembly. A diagonal line, usually with an additional straight line near one end of the slats, can be referred to by inverting a slat or slats or (particularly to confirm a completed puzzle) by viewing the edges through an aperture in the bottom of the assembly box.

Also contemplated is a puzzle where the slats are on a web or on sheets, perforated between the slats, but neither separated nor folded, those tasks being left to the solver. If desired, peel and stick or two part adhesive can be mounted or printed onto the reverse of the slats to be folded.

A set of flip book animation images can be printed on the slat faces, so that a properly assembled puzzle will reward the user with a short movie.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A picture puzzle comprising:

a plurality of slats;

each of said slats comprising on at least part of an edge thereof, an extended image slice of a target image; the image slice being extended generally perpendicular to the edge; wherein the extended image slice is substantially extended beyond the edge, along the surface of the slat wherein the extended image slice is extended to at least three times the slat thickness.

2. The puzzle of claim 1, wherein a typical slat comprises a substrate that is folded roughly parallel to the long axis of the extended image slice to form the edge of the slat bearing the extended image slice.

3. The puzzle of claim 2, wherein the substrate is bonded to secure the fold.

4. The puzzle of claim 3, wherein the substrate is bonded to itself.

5. The puzzle of claim 3, wherein the substrate is folded over and bonded to a core.

6. The puzzle of claim 2, wherein the substrate is folded approximately in half.

7. The puzzle of claim 2, wherein a slat comprises at least two of said edges.

8. The puzzle of claim 2, wherein a typical slat comprises a substrate that is folded roughly parallel to the long axis of the extended image slice; and wherein at least two folds form an edge of the slat.

9. The puzzle of claim 1, wherein the extended image slice is extended by copying.

10. The puzzle of claim 1, wherein the extended image slice is extended by stretching.

11. The puzzle of claim 1, wherein the extended image slice is extended by repetition.

12. The puzzle of claim 1, wherein the extended image slice is extended non-uniformly.

13. The puzzle of claim 12, wherein the extended image slice is extended differentially by color.

14. A picture puzzle comprising:

a plurality of slats being similarly dimensioned and independently moveable;

each of the slats having two relatively broad faces separated by a relatively slender edge face, together forming its surface; and one of a complementary set of graphic images being upon at least part of the surface of each slat on or adjacent to at least part of the edge face, each of the set of graphic images being modified from each of a set of effectively successive, essentially parallel slices of an artwork;

the modification comprising extending the slice such that each graphic image is substantially broader, perpendicular to the direction of slicing, than the slice from which it was modified with each graphic image retaining visual characteristics of the slice across a substantial part of the breadth of the graphic image; and wherein the slats are juxtaposed broad face to broad face to display a limited portion of each graphic image;

whereby correct ordering of the slats in the broad face to broad face arrangement completes a target image resembling the artwork.

15. The picture puzzle according to claim 14, wherein the slats are generally rectangular.

16. The picture puzzle according to claim 14, wherein a typical slat comprises a substrate that is folded to form the edge of the slat.

17. The picture puzzle according to claim 16, wherein the substrate is bonded to secure the fold.

18. The picture puzzle according to claim 17, wherein the substrate is bonded to itself.

19. The picture puzzle according to claim 17, wherein the substrate is folded over and bonded to a core.

20. The picture puzzle according to claim 16, wherein the substrate is folded approximately in half.

21. The picture puzzle according to claim 16, wherein a slat comprises at least two of said edges.

22. The picture puzzle according to claim 16, wherein at least two folds form an edge of the slat.

23. The picture puzzle according to claim 14, wherein the slice is extended by copying.

24. The picture puzzle according to claim 14, wherein the slice is extended by stretching.

25. The picture puzzle according to claim 14, wherein the slice is extended by repetition.

26. The picture puzzle according to claim 14, wherein the slice is extended non-uniformly.

27. The picture puzzle according to claim 26, wherein the slice is extended differentially by color.

28. The picture puzzle according to claim 14, wherein the slice is extended to at least three times the slat thickness.

29. The picture puzzle according to claim 14, wherein the slats are positioned in alignment such that the target image comprises those portions of the graphic images that appear on the edge faces of the slats.

30. The picture puzzle according to claim 14, wherein the slats are positioned each offset from the next, such that the target image comprises portions of the graphic images that appear on the broad faces of the slats.

31. The picture puzzle according to claim 30, wherein the offsets are formed by essentially uniform tilt of the slats.

* * * * *